US010559418B2

(12) United States Patent
Lai et al.

(10) Patent No.: US 10,559,418 B2
(45) Date of Patent: Feb. 11, 2020

(54) INVERTER STRUCTURE AND METHOD FOR ASSEMBLING THE SAME

(71) Applicant: P-DUKE TECHNOLOGY CO., LTD., Taichung (TW)

(72) Inventors: Chia-Ti Lai, Taichung (TW); Yung-Chi Chang, Taichung (TW); Ta-Wen Chang, Taichung (TW); Hsiao-Hua Chi, Taichung (TW); Lien-Hsing Chen, Taichung (TW)

(73) Assignee: P-DUKE TECHNOLOGY CO., LTD., Taichung (TW)

( * ) Notice: Subject to any disclaimer, the term of this patent is extended or adjusted under 35 U.S.C. 154(b) by 155 days.

(21) Appl. No.: 15/616,266

(22) Filed: Jun. 7, 2017

(65) Prior Publication Data

US 2018/0358173 A1 Dec. 13, 2018

(51) Int. Cl.

| | |
|---|---|
| ***H01F 27/28*** | (2006.01) |
| ***H01F 27/32*** | (2006.01) |
| ***H01F 27/26*** | (2006.01) |
| ***H01F 3/14*** | (2006.01) |
| ***H01F 27/34*** | (2006.01) |
| ***H01F 27/29*** | (2006.01) |

(52) U.S. Cl.

CPC ..... *H01F 27/325* (2013.01); *H01F 3/14* (2013.01); *H01F 27/263* (2013.01); *H01F 27/266* (2013.01); *H01F 27/28* (2013.01); *H01F 27/292* (2013.01); *H01F 27/346* (2013.01)

(58) Field of Classification Search

CPC ..... H01F 27/00–36
USPC .... 336/65, 83, 192, 196, 198, 200, 232–234
See application file for complete search history.

(56) References Cited

U.S. PATENT DOCUMENTS

| | | | | |
|---|---|---|---|---|
| 9,343,219 | B2 * | 5/2016 | Kawaguchi | H01F 27/02 |
| 2006/0066246 | A1 * | 3/2006 | Ushijima | H01J 61/56 315/57 |
| 2008/0297296 | A1 | 12/2008 | Teng et al. | |

FOREIGN PATENT DOCUMENTS

| | | | |
|---|---|---|---|
| DE | 112012005935 | T5 | 12/2014 |
| JP | 2010232272 | A | 10/2010 |
| TW | 201227764 | A | 7/2012 |
| TW | 201239917 | A | 10/2012 |

OTHER PUBLICATIONS

Search Report dated Dec. 8, 2017 of the corresponding Taiwan patent application No. 106111780.
Office Action dated May 29, 2018 of the corresponding German patent application.

* cited by examiner

*Primary Examiner* — Tuyen T Nguyen
(74) *Attorney, Agent, or Firm* — Chun-Ming Shih; HDLS IPR Services

(57) ABSTRACT

A method of assembling an inverter structure (1) includes: winding a coil set (12) around a bobbin (11), the bobbin (11) including a first side (11*a*) and a second side (11*b*) opposite to each other; inserting a first core pillar (21) of a first iron core (20) into a through hole (110) of the bobbin (11); sequentially placing a first insulation body (30), a middle iron core (40) and a second insulation body (50) into the through hole (110) from a second side (11*b*) of the bobbin (11); and inserting a second core pillar (61) of a second iron core (60) into the through hole (110) from the second side (11*b*) of the bobbin (11) and arranging the second core pillar (61) to be in contact with the second insulation body (50).

7 Claims, 5 Drawing Sheets

INVERTER STRUCTURE AND METHOD FOR ASSEMBLING THE SAME

TECHNICAL FIELD

The present invention relates to an inverter technique and, in particular, to a small-size inverter structure and a method for assembling the same.

BACKGROUND

A conventional inverter structure includes a bobbin, a primary winding, a secondary winding and a magnetic core set. The primary winding and the secondary winding wind around the bobbin in spaced-apart relationship. Furthermore, the magnetic core set is assembled to the bobbin wound by the primary and secondary windings and is partially inserted in a passage of the bobbin, so a construction of the inverter structure is completed.

In addition, in this day, electronic products often need to be small, slim and light, so a size of the inverter is reduced. However, when the size of the inverter is smaller, a distance between the magnetic core set and the windings also becomes smaller. As a result, the magnetic field generated by the magnetic core set affects the external windings and causes electromagnetic interference and a great magnetic loss, which leads to reduction in conversion efficiency of the inverter.

In views of this, in order to solve the above disadvantage, the present inventor studied related technology and provided a reasonable and effective solution in the present disclosure.

SUMMARY

It is an object of the present invention to provide an inverter structure and a method for assembling the same. Magnetic fields of a first iron core, a middle iron core and a second iron core do not affect an external bobbin set, thus reducing a magnetic loss and improving efficiency.

It is another object of the present invention to provide an inverter structure and a method for assembling the same, whereby magnetic field radiation can be reduced, and electromagnetic interference is also reduced. Accordingly, the present invention provides an inverter structure including a bobbin set, a first iron core, a first insulation body, a middle iron core, a second insulation body, and a second iron core. The bobbin set includes a bobbin and a coil set winding around the bobbin. The bobbin includes a through hole. The first iron core includes a first core pillar, the first iron core is inserted through one side of the bobbin. The first core pillar is received in the through hole. The first insulation body is disposed in the through hole and is in contact with one side of the first core pillar. The middle iron core is disposed in the through hole and is in contact with the first insulation body. The second insulation body is disposed in the through hole and is in contact with another side of the middle iron core opposite to the first insulation body. The second iron core includes a second core pillar, the second iron core is inserted through another side of the bobbin opposite to the first iron core, and the second core pillar is received in the through hole and is in contact with the second insulation body.

Accordingly, the present invention provides a method for assembling the inverter structure, comprising: winding the coil set around the bobbin, the bobbin including a first side and a second side opposite to each other; inserting the first core pillar of the first iron core into the through hole of the bobbin from the first side of the bobbin; placing sequentially the first insulation body, the middle iron core and the second insulation body into the through hole of the bobbin from the second side of the bobbin, arranging the first insulation body to be in contact with the first core pillar, and arranging the middle iron core to be sandwiched between the first insulation body and the second insulation body; and inserting the second core pillar of the second iron core into the through hole of the bobbin from the second side of the bobbin, and arranging the second core pillar to be in contact with the second insulation body.

Compared with conventional techniques, the first iron core, the middle iron core and the second iron core are linearly connected in the bobbin set of the inverter structure, and the first insulation body is sandwiched between the first iron core and the middle iron core. Furthermore, the second insulation body is sandwiched between the second iron core and the middle iron core. Accordingly, the first iron core, the middle iron core and the second iron core linearly connected inside the bobbin set form multiple magnetic fields with multiple air gaps, and the magnetic fields cover a relative smaller range. Therefore, the magnetic fields do not affect a magnetic field of the external bobbin set, thus reducing a magnetic loss, improving efficiency and enhancing practicability.

BRIEF DESCRIPTION OF THE DRAWINGS

The disclosure will become more fully understood from the detailed description, and the drawings given herein below is for illustration only, and thus does not limit the disclosure, wherein.

DETAILED DESCRIPTION

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Figure 1:
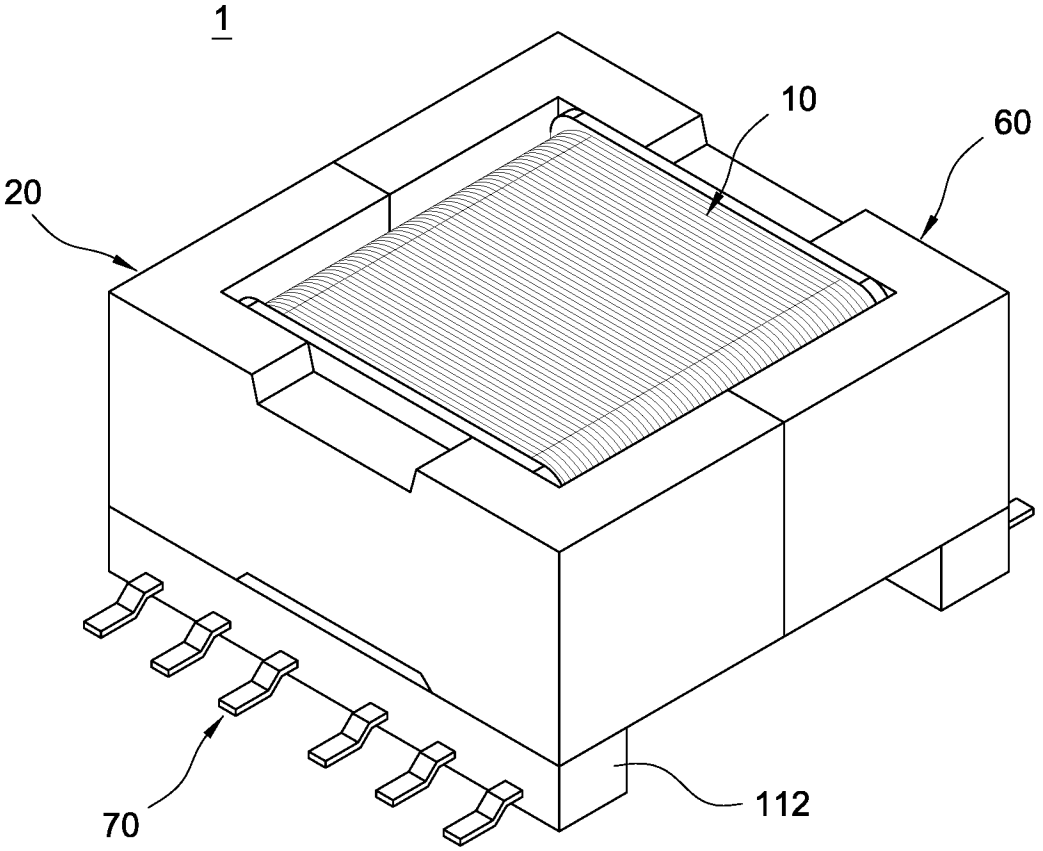
FIG. 1 is a perspective view illustrating an inverter structure according to the present invention.
Figure 2:
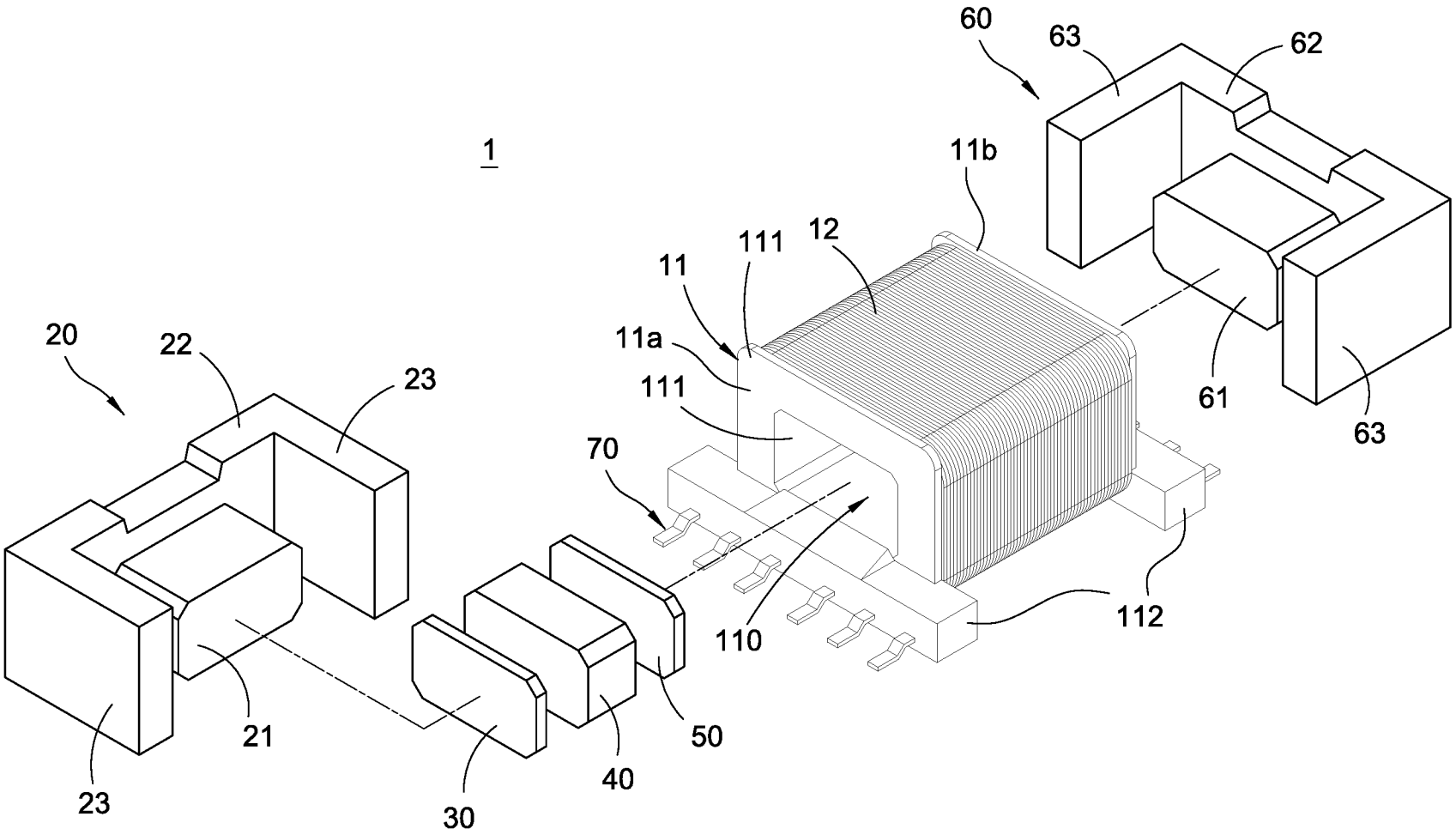
FIG. 2 is a perspective exploded view illustrating the inverter structure according to the present invention.

Please refer to FIGS. 1 and 2, which are a perspective view and a perspective exploded view illustrating an inverter structure according to the present invention. The inverter structure 1 of the present invention includes a bobbin set 10, a first iron core 20, a first insulation body 30, a middle iron core 40, a second insulation body 50, a second iron core 60 and a plurality of conductive leads 70. The first iron core 20 and the second iron core 60 are disposed at two opposite sides of the bobbin set 10. The conductive leads 70 are disposed on a bottom of the bobbin set 10. The first insulation body 30, the middle iron core 40, the second insulation body 50, and the second iron core 60 are inserted in the bobbin set 10, so as to construct the inverter structure 1.

Referring FIG. 2, the bobbin set 10 includes a bobbin 11 and a coil set 12 winding around the bobbin 11. The bobbin 11 includes a through hole 110, and the bobbin 11 has a first side 11*a* and a second side 11*b* opposite to each other. To be specific, the bobbin 11 includes a bobbin sleeve 111 and a plurality of bottom ribs 112 connected to the bobbin sleeve 111. The through hole 110 is disposed in the bobbin sleeve 111, the bottom ribs 112 are disposed at two opposite sides of the bobbin sleeve 111, and the conductive leads 70 are disposed on the bobbin 11 in spaced apart relationship.

The first iron core 20 includes a first core pillar 21, the first iron core 20 is inserted through one side of the bobbin 11, and the first core pillar 21 is received in the through hole 110. In detail, the first iron core 20 includes a first connection plate 22 and two first core plates 23. The two first core plates 23 are disposed at two opposite sides of the first connection plate 22, and the first core pillar 21 is disposed between the two first core plates 23. The two first core plates 23 and the first core pillar 21 extend from the first connection plate 22 along the same direction. It is preferable that a length of the first core pillar 21 extending from the first connection plate 22 is shorter than a length of each of the two first core plates 23 extending from the first connection plate 22, thereby reducing a whole size of the inverter structure 1.

The first insulation body 30 is disposed in the through hole 110 of the bobbin 11 and is in contact with one side of the first core pillar 21. The middle iron core 40 is also disposed in the through hole 110 and is in contact with the first insulation body 30. The second insulation body 50 is also disposed in the through hole 110 of the bobbin 11 and is in contact with another side of the middle iron core 40 opposite to the first insulation body 30. It is preferable that, each of the first insulation body 30 and the second insulation body 50 is an insulation plate, and the middle iron core 40 is an I-shaped iron core.

The second iron core 60 includes a second core pillar 61, the second iron core 60 is inserted through another side of the bobbin 11 opposite to the first iron core 20, the second core pillar 61 is received in the through hole 110 and is in contact with the second insulation body 50. Specifically, the second iron core 60 further includes a second connection plate 62 and two second core plates 63. The two second core plates 63 are arranged spaced apart from each other at two opposite sides of the second connection plate 62, the second core pillar 61 is disposed between the two second core plates 63, and the two second core plates 63 and the second core pillar 61 extend from the second connection plate 62 along the same direction. It is preferable that, a length of the second core pillar 61 extending from the second connection plate 62 is shorter than a length of each of the two second core plates 63, thereby reducing a whole size of the inverter structure 1.

Figure 3:
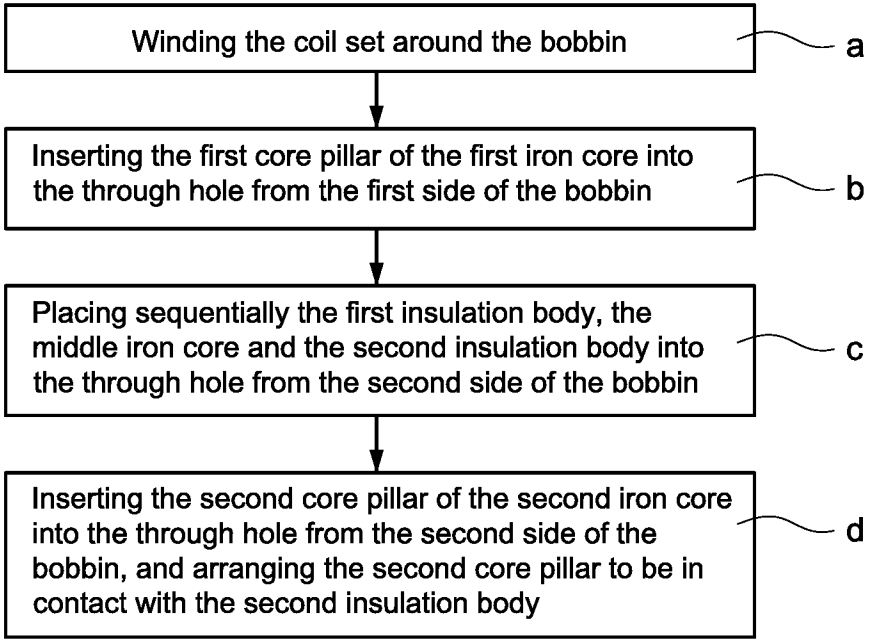
FIG. 3 is a process flow diagram illustrating the inverter structure according to the present invention.

Please refer to FIG. 3, which is a process flow diagram illustrating a method for assembling the inverter structure. The inverter structure is assembled by the following way. First, the bobbin set 10 is provided. The coil set 12 is wound around the bobbin 11 (step a), wherein the bobbin 11 includes a first side 11*a* and a second side 11*b* opposite to each other. Then, the first core pillar 21 of the first iron core 20 is inserted into the through hole 110 of the bobbin 11 from the first side 11*a* of the bobbin 11 (step b).

The first insulation body 30, the middle iron core 40 and the second insulation body 50 are sequentially placed into the through hole 110 of the bobbin 11 from the second side 11*b* of the bobbin 11, the first insulation body 30 is arranged to be in contact with the first core pillar 21, and the middle iron core 40 is sandwiched between the first insulation body 30 and the second insulation body 50 (step c).

Furthermore, the second core pillar 61 of the second iron core 60 is inserted into the through hole 110 of the bobbin 11 from the second side 11*b* of the bobbin 11, and the second core pillar 61 is arranged to be in contact with the second insulation body 50 (step d). Then, the conductive leads 70 are disposed on the bobbin 11 in spaced-apart relationship. Finally, the first iron core 20 and the second iron core 60 are fixed to the bobbin, so as to complete assembling of the inverter structure 1.

Figure 4:
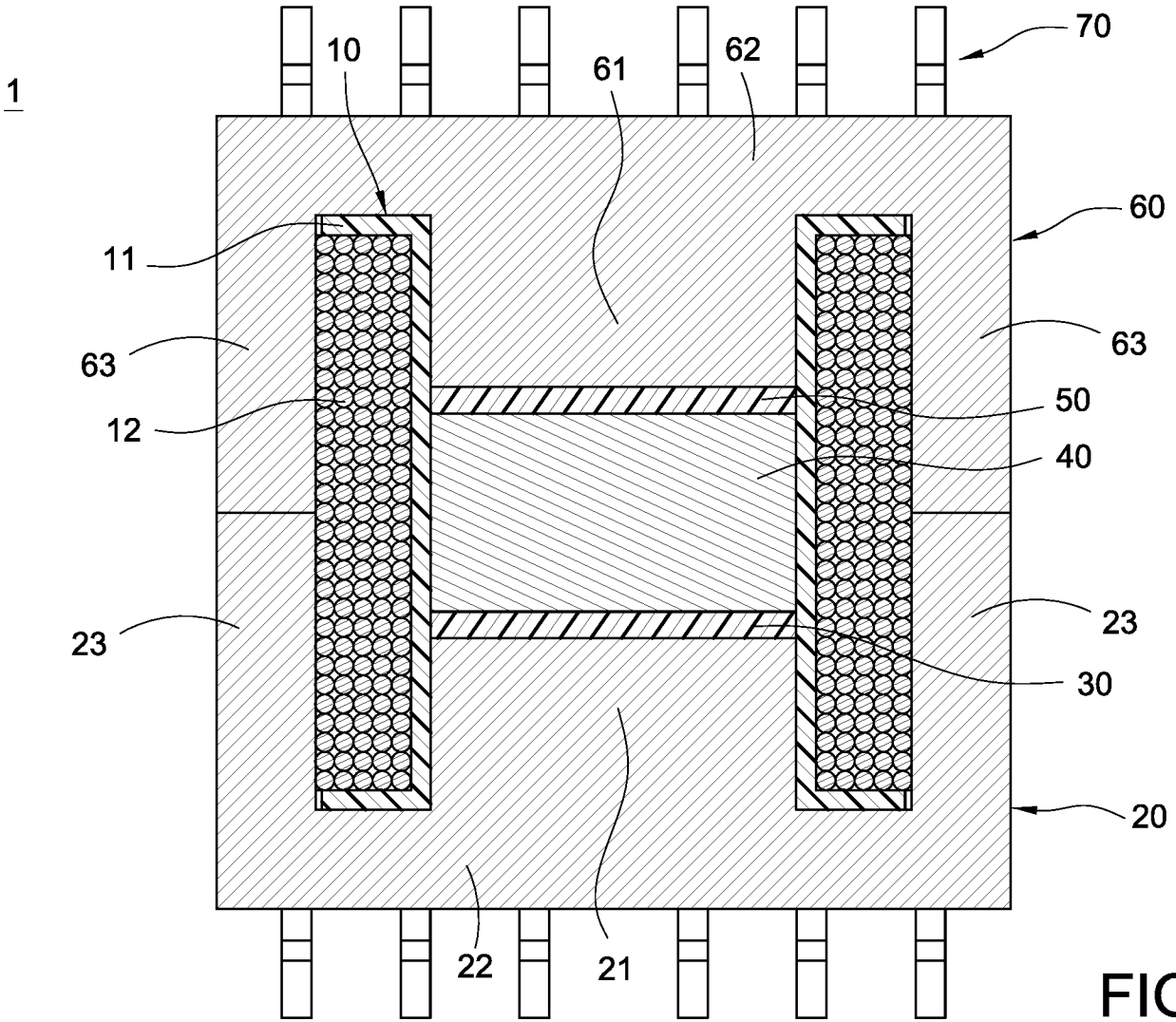
FIG. 4 is a cross-sectional view illustrating the inverter structure according to the present invention.

Please refer to FIG. 4, which is a cross-sectional view illustrating the inverter structure. After the inverter structure is constructed according to the above-mentioned method, the first iron core 20 and the second iron core 60 are disposed on the bottom ribs 112 of the bobbin 11. Moreover, the two first core plates 23 surround the coil set 12 at one side, and the two second core plates 63 surround the coil set 12 at another side opposite to the two first core plates 23. It is preferable that, the two first core plates 23 and the two second core plates 63 surround a periphery of the bobbin 11.

It should be noted that, the middle iron core 40 is disposed in the middle of the through hole 110 of the bobbin 11, and a total length of the first core pillar 21, the first insulation body 30, the middle iron core 40, the second insulation body 50, and the second core pillar 61 is equal to a length of the through hole 110.

Figure 5:
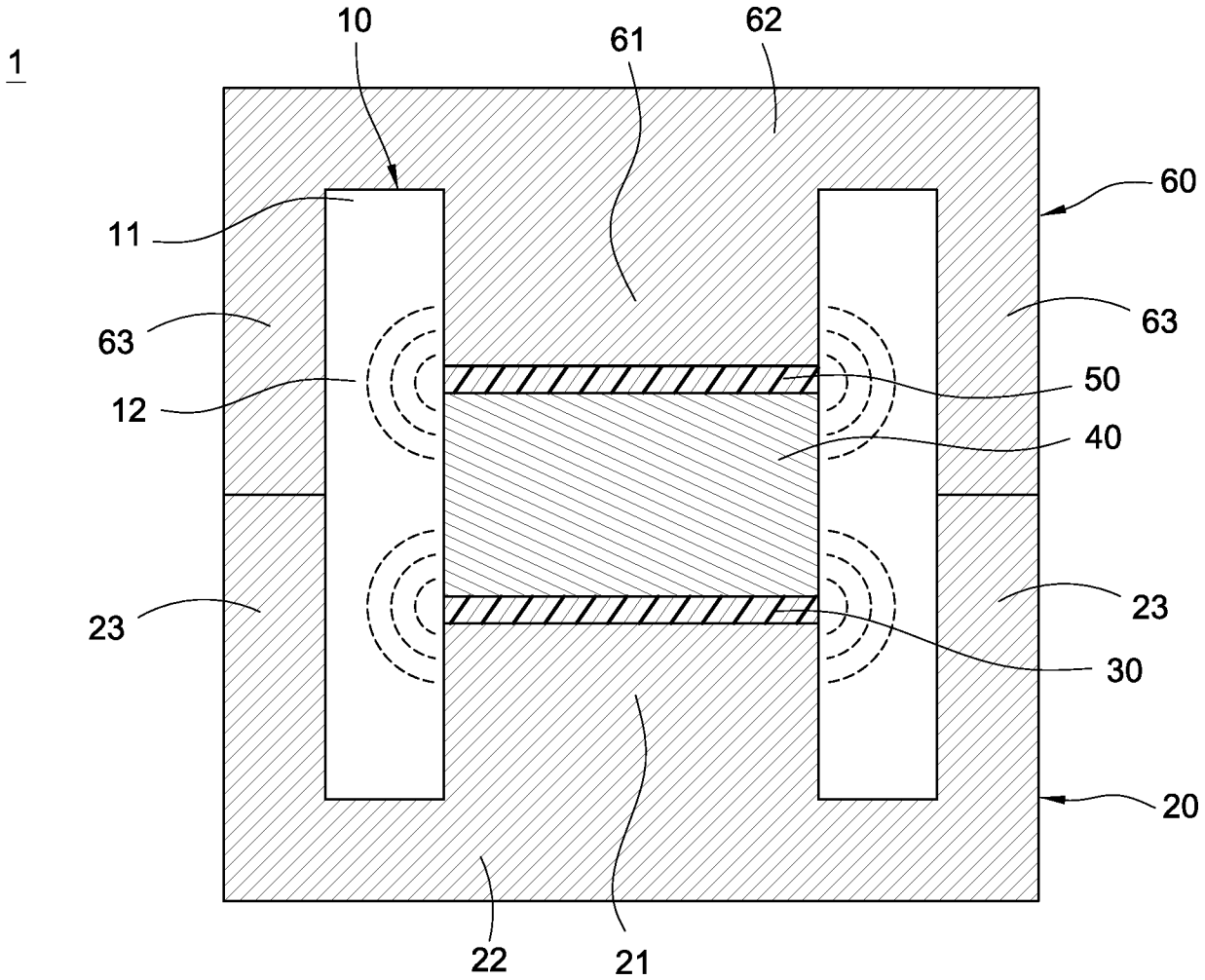
FIG. 5 is a schematic view illustrating magnetic fields of iron cores of the inverter structure according to the present invention.

Please refer to FIG. 5, which is a schematic view showing a magnetic field of the inverter structure. As shown in the drawing, the first iron core 20 (the first core pillar 21), the middle iron core 40 and the second iron core 60 (the second core pillar 61) are inserted in the bobbin set 10. It should be noted that, the first core pillar 21, the middle iron core 40, and the second core pillar 61 are linearly connected and inserted in the bobbin set 10. The first insulation body 30 is sandwiched between the first iron core 20 and the middle iron core 40. The second insulation body 50 is sandwiched between the second iron core 60 and the middle iron core 40.

Accordingly, the first core pillar 21, the middle iron core 40 and the second core pillar 61 form multiple magnetic fields since they are separated by the first insulation body 30 and the second insulation body 50, and the magnetic fields cover a relative small range. Therefore, the magnetic fields formed by the first core pillar 21, the middle iron core 40 and the second core pillar 61 inside the bobbin set 10 do not affect the external bobbin set 10, thus avoiding magnetic interference with the bobbin set 10, reducing a magnetic loss, and improving efficiency.

Specifically, in the inverter structure 1 of the present invention, two air gaps are formed among the first core pillar 21, the middle iron core 40 and the second core pillar 61. Compared to a single air gap of a conventional inverter, a length of the air gap of the present invention is half the length of the air gap of the conventional inverter. Therefore, a magnetic field (magnetic leakage) radiation area is reduced, so the magnetic loss of the external bobbin set caused by the magnetic field is greatly reduced, and efficiency is thereby improved. Moreover, the inverter structure can also reduce magnetic field radiation, thereby decreasing electromagnetic interference (EMI).

It is to be understood that the above descriptions are merely the preferable embodiment of the present invention and are not intended to limit the scope of the present invention. Equivalent changes and modifications made in the spirit of the present invention are regarded as falling within the scope of the present invention.

What is claimed is:

1. An inverter structure (1), comprising:

a bobbin set (10) including a bobbin (11) and a coil set (12) winding around the bobbin (11), the bobbin (11) including a through hole (110);

a first iron core (20) including a first core pillar (21), the first iron core (20) being inserted through one side of the bobbin (11), the first core pillar (21) being received in the through hole (110);

a first insulation body (30), the first insulation body (30) being disposed in the through hole (110) and being in contact with one side of the first core pillar (21);

a single-piece middle iron core (40), the middle iron core (40) being disposed in the through hole (110) and being in contact with the first insulation body (30);

a second insulation body (50), the second insulation body (50) being disposed in the through hole (110) and being in contact with another side of the middle iron core (40) opposite to the first insulation body (30); and a second iron core (60) including a second core pillar (61), the second iron core (60) being inserted through another side of the bobbin (11) opposite to the first iron core (20), the second core pillar (61) being received in the through hole (110) and being in contact with the second insulation body (50);

wherein lengths of the first core pillar and the second core pillar along an extension direction of the through hole are equal or greater than a length of the middle iron core, such that the first insulation body and the second insulation body are disposed closer to a center of the through hole, and magnetic fields formed by the first core pillar, the middle iron core and the second core pillar do not affect the external bobbin set, thereby avoiding magnetic interference and reducing a magnetic loss.

2. The inverter structure according to claim 1, further comprising a plurality of conductive leads (70), the bobbin (11) including a bobbin sleeve (111) and a plurality of bottom ribs (112) connected to the bobbin sleeve (111), the through hole (110) being disposed in the bobbin sleeve (111), the bottom ribs (112) being disposed at two opposite sides of the bobbin sleeve (111), the conductive leads (70) being arranged spaced apart from each other on the bottom ribs (112), the first iron core (20) and the second iron core (60) being disposed on the bottom ribs (112).

3. The inverter structure according to claim 1, wherein each of the first insulation body (30) and the second insulation body (50) is an insulation plate, and the middle iron core (40) is an I-shaped iron core.

4. The inverter structure according to claim 1, wherein the first iron core (20) further includes a first connection plate (22) and two first core plates (23), the two first core plates (23) are disposed at two opposite sides of the first connection plate (22), the first core pillar (21) is disposed between the two first core plates (23), the two first core plates (23) and the first core pillar (21) extend from the first connection plate (22) along the same direction, the second iron core (60) further includes a second connection plate (62) and two second core plates (63), the two second core plates (63) are arranged spaced apart from each other at two opposite sides of the second connection plate (62), the second core pillar (61) is disposed between the two second core plates (63), and the two second core plates (63) and the second core pillar (61) extend from the second connection plate (62) along the same direction.

5. The inverter structure according to claim 4, wherein the length of the first core pillar (21) extending from the first connection plate (22) is shorter than a length of each of the two first core plates (23) extending from the first connection plate (22); and the length of the second core pillar (61) extending from the second connection plate (62) is shorter than a length of each of the two second core plates (63) extending from the second connection plate (62).

6. The inverter structure according to claim 4, wherein the two first core plates (23) surround the coil set (12) at one side, the two second core plates (63) surround the coil set (12) at another side opposite to the two first core plates (23), and the two first core plates (23) and the two second core plates (63) surround a periphery of the bobbin (11).

7. The inverter structure according to claim 1, wherein the middle iron core (40) is disposed in the middle of the through hole (110), and a total length of the first core pillar (21), the first insulation body (30), the middle iron core (40), the second insulation body (50), and the second core pillar (61) is equal to a length of the through hole (110).

* * * * *